US006323404B1

(12) United States Patent
Hayashi

(10) Patent No.: US 6,323,404 B1
(45) Date of Patent: Nov. 27, 2001

(54) MUSIC BOX DEVICE

(75) Inventor: Katsuhiko Hayashi, Hara-mura (JP)

(73) Assignee: Sankyo Seiki Mfg. Co., Ltd., Nagano-ken (JP)

( * ) Notice: Subject to any disclaimer, the term of this patent is extended or adjusted under 35 U.S.C. 154(b) by 0 days.

(21) Appl. No.: 09/701,411

(22) PCT Filed: May 28, 1999

(86) PCT No.: PCT/JP99/02812

§ 371 Date: Feb. 8, 2001

§ 102(e) Date: Feb. 8, 2001

(87) PCT Pub. No.: WO99/62051

PCT Pub. Date: Dec. 2, 1999

(30) Foreign Application Priority Data

May 28, 1998 (JP) ..... 10-164330

(51) Int. Cl.[7] ..... G10F 1/06

(52) U.S. Cl. ..... 84/94.1; 84/94.2; 84/95.1; 84/95.2

(58) Field of Search ..... 84/94.1, 94.2, 84/95.1, 95.2, 96, 97, 108

(56) References Cited

U.S. PATENT DOCUMENTS 315,774 * 4/1885 Hakins ..... 84/94.1
4,557,173 * 12/1985 Isaka ..... 84/95.1
5,543,577 * 8/1996 Zhu et al. ..... 84/95.2

FOREIGN PATENT DOCUMENTS

S61-18557 * 6/1986 (JP) .
S63-35100 * 3/1988 (JP) .
S63-264792 * 11/1988 (JP) .
H8-50476 * 2/1996 (JP) .
H8-221057 * 8/1996 (JP) .
H8-248951 * 9/1996 (JP) .

* cited by examiner

*Primary Examiner*—Shih-Yung Hsieh
(74) *Attorney, Agent, or Firm*—Reed Smith LLP

(57) ABSTRACT

A music box device whose constitution member is put together into a unit is provided. A pedestal housing 36 for storing therein a spring 38 as well as a pedestal 30 for supporting a spring gear 58 and speed increasing gear trains 32, and 33 of a governor mechanism 24 are formed with synthetic resin mould to be united therewith. A rotating shaft of the speed increasing gear train 32 of the governor mechanism 24 and a rotating shaft 26 of the governor rotating body 25 are supported in cooperation with the pedestal 30 and a spring storage box 36, thus a spring power source unit supplying controlled stable rotating output is constituted.

18 Claims, 4 Drawing Sheets

MUSIC BOX DEVICE

TECHNICAL FIELD

The present invention relates to a music box device which plays a vibration plate with pins provided on surface of a rotary drum.

BACKGROUND

A conventional music box, as indicated in U.S. Pat. No. 4,557,173, includes a KOUBAKO (a spring storage box) storing therein the spring, a rotary drum driven in one direction in accordance with release of stored force of the spring, a sound vibration valve (hereinafter referred to as only vibration plate) sounding while being played with engaging pin provided on the surface of the rotary drum, a governor mechanism for rotating the rotary drum with fixed speed, gear train for coupling the governor mechanism and the spring. Such functional members described-above are mounted directly on a casting metallic frame made of zinc die casting or iron or so forth. Further, a member which includes a part of supporting section of gear train and one side of bearing section that supports a governor rotating body, which member leads a braking section of the governor mechanism from the spring storage box, is formed with synthetic resin in a body.

However, since the bearing section which supports rotary members such as the governor rotating body and respective gears and so forth is integrated with the frame concentrically, shape of the frame becomes complicated, so processing is difficult. Further, a casting metal such as a zinc die casting and so forth to be material of the frame has large coefficient of friction. Accordingly, when a rotary member which rotates in high speed is supported directly on the frame, rotation transfer efficiency of the gears deteriorates, thus the spring with small stored capacity of driving force becomes disadvantage.

So, it is an object of the present invention to provide a music box device in which a bearing section of a rotary member is formed with synthetic resin separately from the frame so as to improve a rotation transfer efficiency of a gear, and in which a spring, a gear train, and a governor mechanism are configured as one body unit to facilitate installation for the frame.

DISCLOSURE OF INVENTION

The music box device concerning the present invention, whose spring drive mechanism and governor mechanism are constituted as a supporting unit formed from a pedestal made of synthetic resin, which is supported independently to be separated from a base frame, therefore, in a few chances, fault of the base frame affects the supporting unit. Thus it is capable of improving drive performance of the music box. Further, when individual fault portion or repair portion in the drive mechanism, the governor mechanism and so forth occurs, partial exchange in every unit becomes possible, thus management cost for repair can be reduced. Furthermore, assembling in every unit of the drive mechanism, the governor mechanism and so forth and parts management become easy, thus it is capable of scheming improvement of production efficiency. In particular, it becomes possible to execute production in every unit of the drive mechanism, the governor mechanism and so forth as well as final assembling to the music box device in the optimum production area respectively, thus it is capable of reducing production cost.

Further, since a bearing section for supporting a speed increasing gear train of the governor mechanism and a governor rotating body is made of synthetic resin as a part of a supporting unit, friction loss of a bearing is reduced, thus it is capable of transferring stored force of a spring in high efficiency without loosing en route for transferring, therefore, it is capable of extending a performance time of the music box.

On the other hand, there is provided a hooking member with which a pedestal and a pedestal housing are engaged in the neighborhood of a transfer gear to prevent separation of a contact close section of U-shaped opening supporting section caused by torque of a rotary drum, and outer periphery of opening section of a spring storage section is formed continuously, further strengthening opening section of the spring storage section while covering the opening section with cylindrical convex edge of the pedestal. Even though the supporting unit is made of synthetic resin, it is capable of preventing deformation caused by repulsion force of the spring, accordingly, it is capable of securing sufficient strength capable of withstanding load caused by spring driving.

BEST MODE FOR CARRYING OUT THE INVENTION

Figure 1:
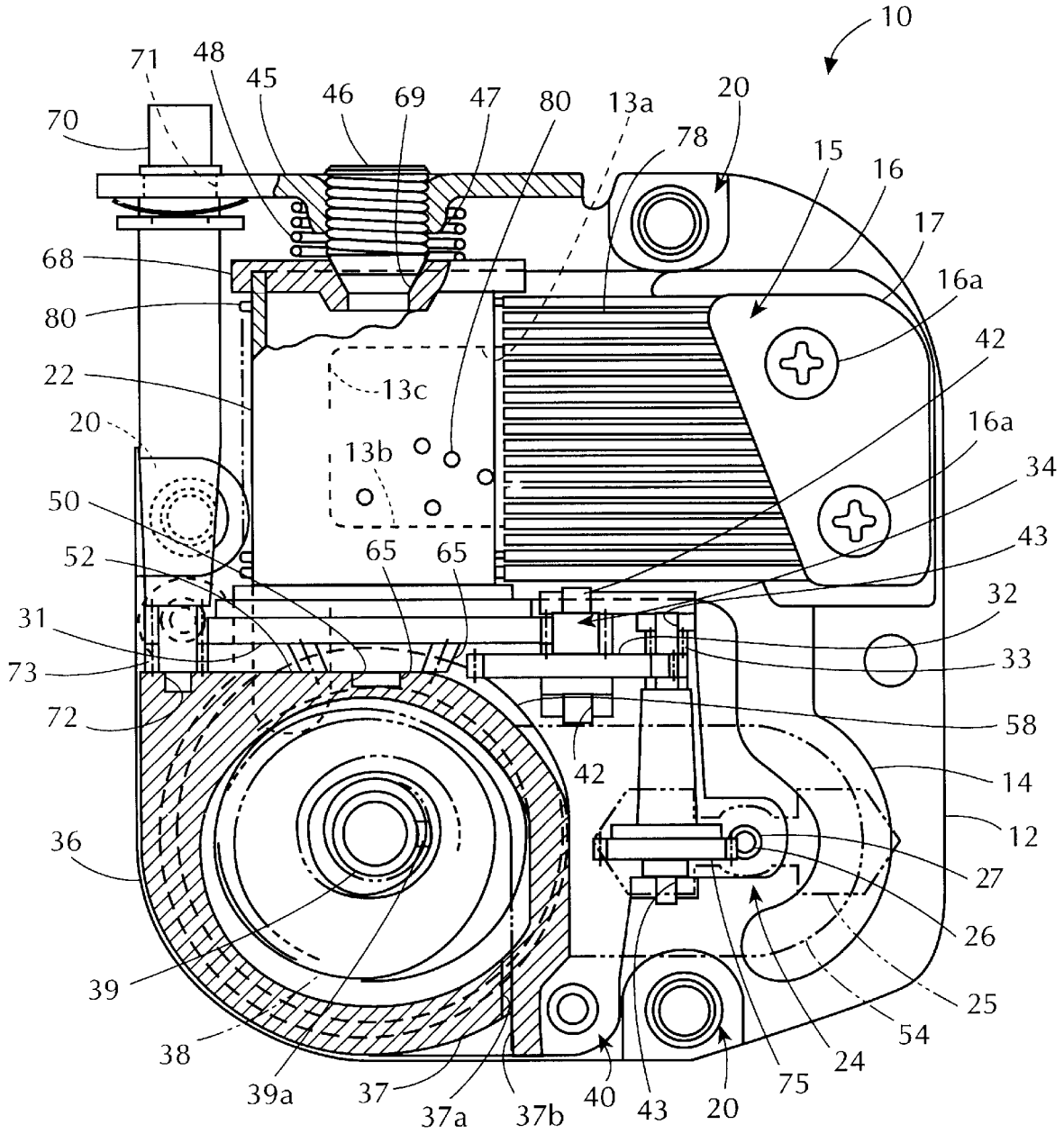
FIG. 1 is a plan view indicating a first embodiment of a music box device concerning the present invention.
Figure 2:
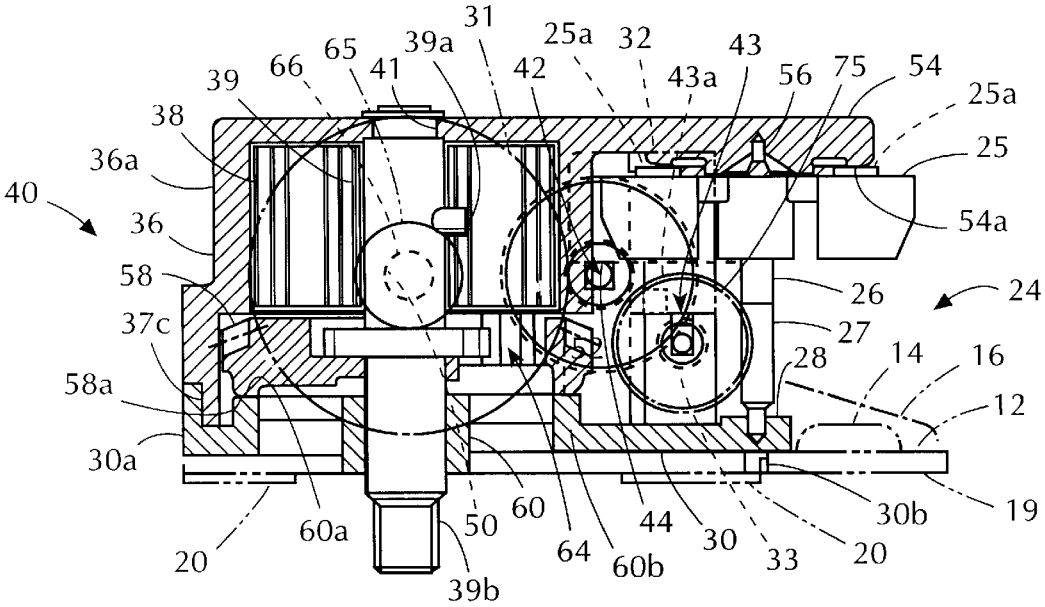
FIG. 2 is a side view of supporting unit in the first embodiment of the music box device concerning the present invention.

Hereinafter, there will be described about an embodiment of a music box device concerning the present invention in accordance with a drawing of the first embodiment. FIG. 1 is a plan view indicating the whole of music box device 10. FIG. 2 is a side view indicating section of a supporting unit 40. A base frame 12 is formed y drawing of causing metal plate material, for instance, thin steel plate of 1.2 mm thick to be subjected to plastic deformation. Ribs 13*a*, 13*b*, 13*c*, and 14 are provided for the sake of improvement of stiffness. Discontinuity parts of the base frame 12 caused by a lack portion such as hole after cut-raising processing is relieved to keep suitable sound quality. Further, it is also suitable of causing surface of metal plate material to undergo work hardening while performing grain-processing to the surface of the metal plate material to improve intensity and flatness. Here, the grain-processing is that press pressing processing such as coining processing is performed on a surface of metal plate and so forth. According to this processing, grain shaped press patterns are formed uniformly on the whole surface. Furthermore, it is suitable that thickness of the metal plate material is capable of being subjected to plastic processing. Thickness is suitable not more than 3 mm.

Reference numeral 15 is a vibration plate. A vibration plate mounting surface of a vibration plate mounting stand 16, which is provided at the base frame 12 is formed broader than surface of the base 17 of the vibration plate 15. The whole surface of the vibration plate base 17 of the vibration plate 15 is fixed firmly with tapping screw 16*a* such that the vibration plate 15 is adhered to the vibration plate mounting surface closely. Thus it is capable of improving sound quality while reducing transfer loss of the vibration due to the fact of causing the part near the base of a valve of the vibration plate at least to be adhered to the vibration plate mounting stand. Further, in the base 19 of the base frame 12, three points of small areas of convex surface formed at the alienated position mutually that occupy the apexes of a triangle are taken to be mounting stands 20. Three points without existing on the same straight line demarcate a plane. Even though there are some unevenness on the mounted surface, since the plane demarcated from three points gauges the mounted surface, it is capable of mounting the base frame 12 surely without unstableness, thus making transfer of excellent sound to the mounted body such as jewel box and so forth possible. A protrusion from the base frame 12 of the vibration plate mounting stand 16 is R-shaped portion.

The ribs 13*a*, 13*b*, 13*c*, and 14 stiffen stiffness of the base frame 12 according to plastic deformation processing of thin steel plate. The ribs 13*a*, 13*b*, 13*c*, and 14 are ridge-shaped convex sections whose section continues with arc shaped protruded. A rib group is constituted from two ridges of the ribs 13*a*, and 13*b* elongating to under part of mounted position of a rotary drum 22 from the vibration plate mounting stand 16, and the rib 13*c* which unites these ribs. The rib group and the vibration plate mounting stand form four-sided section at under side of the vibration plate 15 and the rotary drum 22. Even though the base frame 12 undergoes stress from its external environment, related position between the vibration plate 15 and the rotary drum 22 does not change easily because the base frame 12 does not curve due to the rib group. Namely, it is prevented fluctuation of engaged distance between pointed ends which are drawn up in a line of a comb-shaped vibration valve 78 formed on the vibration plate 15 and engaging pin 80 set on outer peripheral surface of the rotary drum 22 so that it is capable of being maintained the engaged distance accurately.

Another rib 14 exists while surrounding outer peripheral portion of the neighborhood of the bearing of a worm 27 to be a rotating shaft 26 of a governor rotating body 25 from the vibration plate mounting stand 16 in arc shaped condition. The rib 14 stiffs stiffness of the base frame 12 in the neighborhood of a governor device. Governor operation of a governor rotating body 25 which rotates in high speed of a governor mechanism 24 is not prevented from deformation of the base frame 12, a rotation of the governor rotating body 25 is stable, thus it is capable of maintaining governor operation surely.

Figure 3:
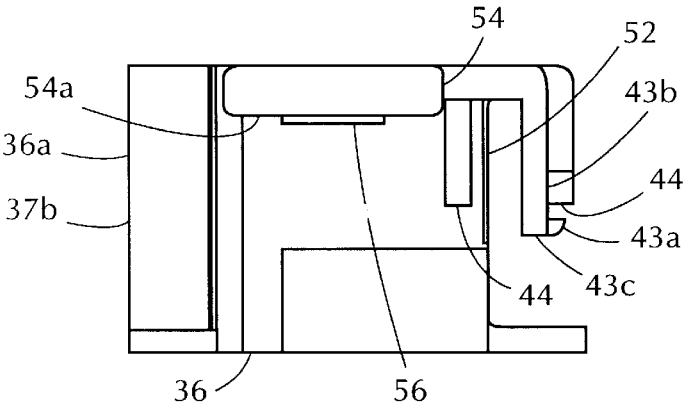
FIG. 3 is a front view of a spring storage box,side of the supporting unit of the first embodiment of the music box device concerning the present invention.
Figure 4:
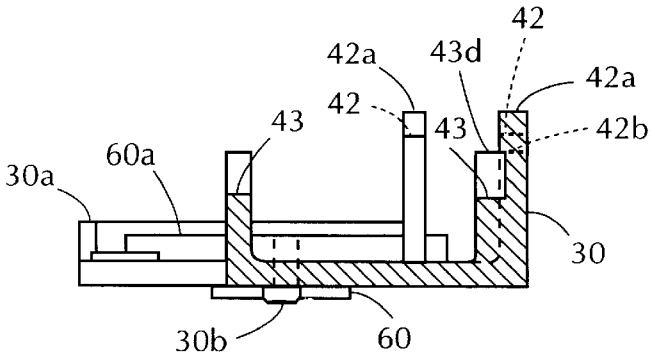
FIG. 4 is a front view of a pedestal side of the supporting unit in the first embodiment of the music box device concerning the present invention.

In FIG. 1 to FIG. 4 indicating the first embodiment, Reference numeral 30 is a pedestal supporting a speed increasing gear train 34 consisting of composite spur gears 31, 32, and 33, and the worm 27. Reference numeral 36 is a pedestal housing including a spring storage section 36*a* for storing therein a spring 38 to be drive source of a music box. Reference numeral 39 is a spring winding shaft. Further, FIG. 3 and FIG. 4 are respective front views of a pedestal 30 and a pedestal housing 36.

Reference numeral 40 is a supporting unit consists of two members of divided the pedestal 30 and the pedestal housing 36 that are constituted as separated members from the base frame 12. The supporting unit 40 supports the governor mechanism 24 with the governor mechanism 24 surrounded according to two members of the pedestal 30 divided into the upper and the lower sides in the direction of the shaft of the spring winding shaft 39 as well as the pedestal housing 36. The governor mechanism 24 includes the speed increasing gear train 34 which radiates the stored force while controlling stored force of the spring 38 to be a spring drive mechanism driving the rotary drum 22 and the spring winding shaft 39 and the spring 38. Namely, the supporting unit 40 holds the spring drive mechanism and the governor mechanism as separated independent unit from the base frame. Thus, when the spring and the governor mechanism to be a drive source are taken to be one body of unit which is a separated standard unit from the base frame, parts management and assembling become easy. It is capable of reducing product cost. Further, it is suitable that the supporting unit is divided into two members in the direction of an output shaft 70 without dividing into two members in the direction of shaft of the spring winding shaft 39. Furthermore, the spring winding shaft 39 also can be provided in such a way of causing the spring winding shaft 39 to be parallel to the base of the base frame 12 and to be perpendicular to rotating shaft of the rotary drum.

Both the pedestal 30 and the pedestal housing 36 are made of synthetic resins mould. A connected portion is combined into one body according to an appropriate means such as caulking or adhesion, thus the supporting unit 40 is formed. An opening 50 for bearing for rotationally supporting one side of shaft 66 of the rotary drunk 22 as well as a bearing hole 72 for supporting one end of an output shaft 70 are provided at an outer side surface of the supporting unit 40. Further, a positioning pin 30*b* for controlling installation position accurately is provided at the base of the supporting unit 40 opposite to the base frame 12. It is capable of performing easily coupling assembly between another members such as the rotary drum 22, the output shaft 70, the base frame 12 and so forth and the supporting unit with accurate position relationship maintained due to the positioning pin 30*b*. Furthermore, the pedestal housing 36 is desirable to be made of synthetic resin. However, when powerful spring is employed, it is suitable to form only the spring storage section 36*a* or the whole of the pedestal housing 36 by press while performing press processing high strength metal plate in order to secure intensity of the spring storage section 36*a*.

In the composite spur gears 32, and 33 of the speed increasing gear train 34, respective large and small spur gears and the rotating shaft are formed integrately. Bearings of respective rotating shaft are constituted by U-shaped upper-opening supporting sections 42, and 43 at a bearing support of the pedestal 30. The rotating shaft is assembled to be supported rotationally while fitting to be inserted the rotating shaft to be thrown down from the opening end section side.

However, the rotating shaft of the composite spur gear 32 is subjected to an interaction both of rotation torque of the composite spur gear 31, which demarcates one side of the rotating drum 22 integrately integrated with a small bevel gear 65 describe later and braking torque depending on the governor mechanism 24. The rotating shaft of the composite spur gear 32 develops a tendency to float up while being subjected to force in the direction of the opening-end section of the upper-opening supporting section 42. The rotating shaft of the composite spur gear 32 is attempted to deviate from stable bearing position. So, concerning the bearing of the composite spur gear 32, a supporting surface 44 provided at a part of the pedestal housing 36 is set to an opening-end 42*a* of the upper-opening supporting section 42, so that floating of the rotating shaft caused by force in the direction of the opening-end section is prevented. Namely, the bearing of the composite spur gear 32 is constituted from divided two parts of the side of the pedestal 30 and the side of the pedestal housing 36.

Further, the force which causes the rotating shaft of the composite spur gear 32 to be forced in the direction of the opening-end section of the upper-opening supporting section 42, gives load to the pedestal housing 36 in the degree that the force deforms the pedestal housing 36. Accordingly, there are some possibilities of occurrence of a gap between contacted surfaces with each other while being alienated the supporting surface 44 from the opening-end 42*a*. In order to prevent the occurrence of the gap, it causes a square hole 42*b* to be perforated in the elongated portion toward FIG. 4 upper side of a bearing support including the upper-opening supporting section 43 which supports the rotating shaft of the composite gear 33. There is provided an engaging member at the side, of the pedestal housing 36. The engaging member meshes to be engaged with the square hole 42*b*. The engaging member is a hook 43*a* projecting from a leg base 43*c* elongated toward lower direction of the pedestal housing 36. When it causes the U-shaped upper-opening supporting section 43 to be stopped up while permitting the leg base 43*c* to be touched to the opening-end surface 43*d* of the upperopening supporting section 43 at the side of the pedestal 30, the hook 43*a* is inserted into the square hole 42*b*, thus being prevented floating of supporting surface 44 of the pedestal housing. (referring to FIG. 3 and FIG. 4)

Further, a leg portion 43*b* with the hook 43*a* is formed with elasticity. When the hook 43*a* is inserted into the square hole 42*b*, outer surface of the leg portion 43*b* comes into contact with an inner surface of the bearing support of the pedestal 30 provided with the square hole 42*b*, thus relative position is decided between two upperopening supporting sections 42 and the supporting surface 44.

Since a storage section 36*a* of a spring 38 in the pedestal housing 36 is formed with sufficient depth capable of accommodating width of the spring 38, even though the pedestal 30 is removed from the pedestal housing 36 with the supporting unit 40 disassembled, there is no unexpected accident that released spring 38 flies out of the spring storage section 36*a* caused by free rebounding of remaining stored force.

Further, a lower end portion of the spring storage section 36*a* has a large opening section capable of being inserted the spring 38 easily. An opening-end periphery portion of the opening section is formed continuously. The opening section does not spread further while being deformed caused by rebounding force of the stored spring 38. Furthermore, in the condition that the pedestal 30 is united with the pedestal housing 36, an opening section outer periphery surface 37*c* of the spring storage section 36*a* is inserted into a cylindrical convex edge 30*a* provided at periphery of the pedestal 30. In other words, the cylindrical convex edge 30*a* of the pedestal 30 covers the opening section periphery surface 37*c* of the spring storage section 36*a*. Since the spring storage section 36*a* made of the synthetic resin molding is reinforced, the spring storage section 36*a* has a construction capable of withstanding rebounding force of the spring 38 sufficiently.

A outer end portion of the spring 38 takes the shape of "T". Thus, the outer end portion is formed broadly. The outer end portion is engaged to be hanged to window hole 37*a* provided at a side wall 37. Since a rib 37*b* provided along the window hole 37*a* reinforces the side wall 37 at the periphery of the window hole 37*a*, the rib 37*b* secures strength for the sake of spring maintaining. An inner end portion of the spring 38 is engaged to be hanged to a spring winding shaft 39 by a hooking pin 39*a*. On the other hand, the spring winding shaft 39 whose one end portion is protruded from the pedestal 30 while being supported to be inserted into a bearing 60 provided at the pedestal 30. A protruded end portion of the spring winding shaft 39 is provided with a joining section 39*b* for joining a winding handle of the spring not illustrated. A diminished diameter step portion formed at another end of the spring winding shaft 39 is supported to be inserted into a bearing hole 41 provided at ceiling plate of the pedestal housing 36, thus the step portion comes into contact with the ceiling plate.

Further, the pedestal housing 36 is provided with a bracket 54 protruding along elongated surface of the ceiling plate. The bracket 54 is provided with a bearing 56 for supporting upper end of a worm rotating shaft 26 of the governor rotating body 25, and a braking slip surface for braking rotation of the governor rotating body 25 while slipping to be touched to a braking piece 25*a* of the governor rotating body 25.

The pedestal 30 which constitutes the supporting unit 40 while cooperating with the pedestal housing 36 comprises a bearing 60 for supporting the spring winding shaft 39 which engages with a spring gear 58 in the condition of ratchet-engaging while passing through the spring gear 58, a spring gear supporting stand 60*b* including a slipping surface 60*a* for supporting the spring gear 58 while slipping to be contacted to the base of the spring gear 58 in the surrounding of the bearing 60, upper-opening supporting sections 42, and 43 for supporting rotating shaft of the composite spur gears 32, and 33, and a bearing 28 for supporting the governor rotating body 25 capable of rotation, cooperated with a bearing 56 provided at the side of the pedestal housing 36 while supporting lower end of the worm rotating shaft 26. Further, since a protruded positioning pin 30*b* is provided at the base side opposite to the bearing 28 for deciding position of the supporting unit 40, it is capable of securing sufficient strength while securing thickness of the pedestal 30 of lower end portion of the worm rotating shaft 26. Furthermore, the bearing 60 performs positioning between the pedestal 30 and the base frame 12 while cooperating with the positioning pin 30*b* in accordance with engagement with through hole of the base frame 12.

The spring winding shaft 39 engages to be hooked with an inner end portion of the spring 38 by the hooking pin 39*a*. The spring winding shaft 39 passes through the spring gear 58. The spring winding shaft 39 constitutes one directional clutch through well known ratchet means 64 cooperated with above spring gear 58. Further, slipping section of the base of the spring gear 58 is formed at circular shaped protruded surface 58*a* along outer periphery such that slipping resistance is lessened between the base and the slipping surface 60*a*. Further, it is suitable that a slipping surface 60*a* at the side of the pedestal 30 is taken to be slipping protruded surface instead of the circular shaped protruded surface 58*a* of the spring gear 58.

In the present embodiment, the bearing 60 is engaged directly with the through hole of the base frame 12. However, it is suitable that cylindrical portion of the spring gear supporting stand 60*b* including the slipping surface 60*a* of the pedestal 60 is protruded to be formed to opposite side to the slipping surface 60*a*, thus engaging with corresponding through hole provided at the base frame 12.

The music box device 10 constituted in such a,way of described above, the pedestal 30 of the supporting unit 40 is integrated with supporting sections 42, and 43 by the synthetic resin, therefore, friction loss of the bearing is reduced. So it is capable of transferring stored force of the spring in high efficiency without loosing the stored force halfway. Furthermore, since the supporting unit 40 with sufficient stiffness is fixed to the base frame 12 made of metal plate material with plastic deformation processing through the pedestal 30, there is effect of further strengthening stiffness of the base frame 12.

When the supporting unit 40 is mounted on the base frame 12, a united section 39*b* which couples the spring winding handle is protruded from the base 19 of the base frame 12, therefore it is capable of performing winding operation of the spring 38 while connecting appropriate handle means not illustrated to a protrusion portion of the spring winding shaft 39.

Reference numeral 45 is a bearing frame of the rotary drum 22. The bearing frame 45 is formed in one body while bending a part of elongated portion of the base frame 12 perpendicular to the elongated portion. Further, a flange 68 demarcates one side of end surface of the rotary drum 22, whose periphery wall of a center hole 69 is formed in the condition of taper surface. The flange 68 capable of rotation is supported at the taper surface of a pointed end of a pivot shaft 46 screwed in a boss section 47 protruded from the bearing frame 45. A compressed coil spring 48 intervenes between the bearing frame 45 and the flange 68 of the rotary drum 22, thus being functioned as elastic body for compressing the rotary drum 22 in the thrust direction. The elastic body is not limited to the coil spring.

On the other hand, the small bevel gear 65 engaging with the spring gear 58, which is integrated with the spring winding shaft 39, an orthogonal rotating shaft 66, and the composite spur gear 31, demarcates one side of end surface of the rotary drum 22. The rotating shaft 66 is supported to be inserted into the bearing hole 50 provided at a spring storage box side wall 52 of the supporting unit 40. The spring storage box side wall 52 and rotating surface of the small bevel gear 65 keep slipping condition with appropriate pressing force according to pressurization in the thrust direction due to the compressed coil spring 48. According to this constitution, vibration transfer loss caused by gap is reduced, as well as the rotary drum 22 is capable of rotating smoothly with stable speed with related position in the shaft direction to the vibration plate 15 maintained accurately.

An output shaft 70 provided in parallel to the rotary drum 22 is supported by a bearing hole 72 of the spring storage box side wall 52 and a bearing hole 71 of the bearing frame 45. A pinion 73 integrated therewith engages with the composite spur gear 31 to rotate. The pinion 73 supplies power to a mechanical device such as toy or doll not illustrated. When the rotary drum 22 is mounted between the pedestal housing 36 and the bearing frame 45, the composite spur gear 31 is joined to the speed increasing gear train 34 capable of rotation supported by the supporting unit 40, thus rotation of the composite spur gear 31 is transferred to a worm gear 75 integrated with a composite spur gear 33 through the composite gear 32, then rotating the governor rotating body 25 in high speed under predetermined braking. Further, the output shaft 70 is provided according to demand of usage. Thus, when it is unnecessary to supply power to the mechanical device such as a toy or a doll, or when output to the another direction is performed, the output shaft is not required.

Next, there will be described about operation of the music box device 10 concerning the present invention, in the constitution described-above. When a person winds the spring 38 manually while connecting appropriate handle means to the spring winding shaft 39, rebound force is stored. Since the ratchet means 64 exists, rotation of the spring winding shaft 39 according to winding manipulation is not transferred to the spring gear 58. When the spring winding shaft 39 is set free while stopping winding manipulation, stored force of the spring 38 is released, the spring winding shaft 39 rotates the spring gear 58 through the ratchet means 64.

The small bevel gear 65 engaged with the spring gear 58 rotates while interlocking the spring gear 58 together with the composite spur gear 31 and the rotary drum 22 which are integrated with the small bevel gear 65. At this time, the engaging pin 80 arranged in accordance with specific musical composition on the rotary drum 22 snaps corresponding pointed end of the vibration valve 78, thus performing an individual scale of the vibration valve 78. The output shaft 70 rotates simultaneously to output rotation to interlocking mechanism such as for instance a doll not illustrated.

On the other hand, the rotation transferred to the speed increasing gear train 34 rotates the governor rotating body 25 in high speed, thus controlling radiation at one stroke of stored force of the spring 38 due to the friction resistance between the braking piece 25*a* of the governor rotating body 25 and a braking slipping surface 54*a*, to perform rotation of the rotary drum 22 smoothly, thus keeping tempo of the performance appropriately. Since a bearing section for supporting a rotating shaft of a drive mechanism within the supporting unit 40 is integrated with the pedestal 30 and the pedestal housing 36 with synthetic resin, friction resistance of the bearing is reduced, and energy loss of the spring is lessened, thus load is reduced, with the result that it is capable of increasing storing capacity in the predetermined volume.

Figure 5:
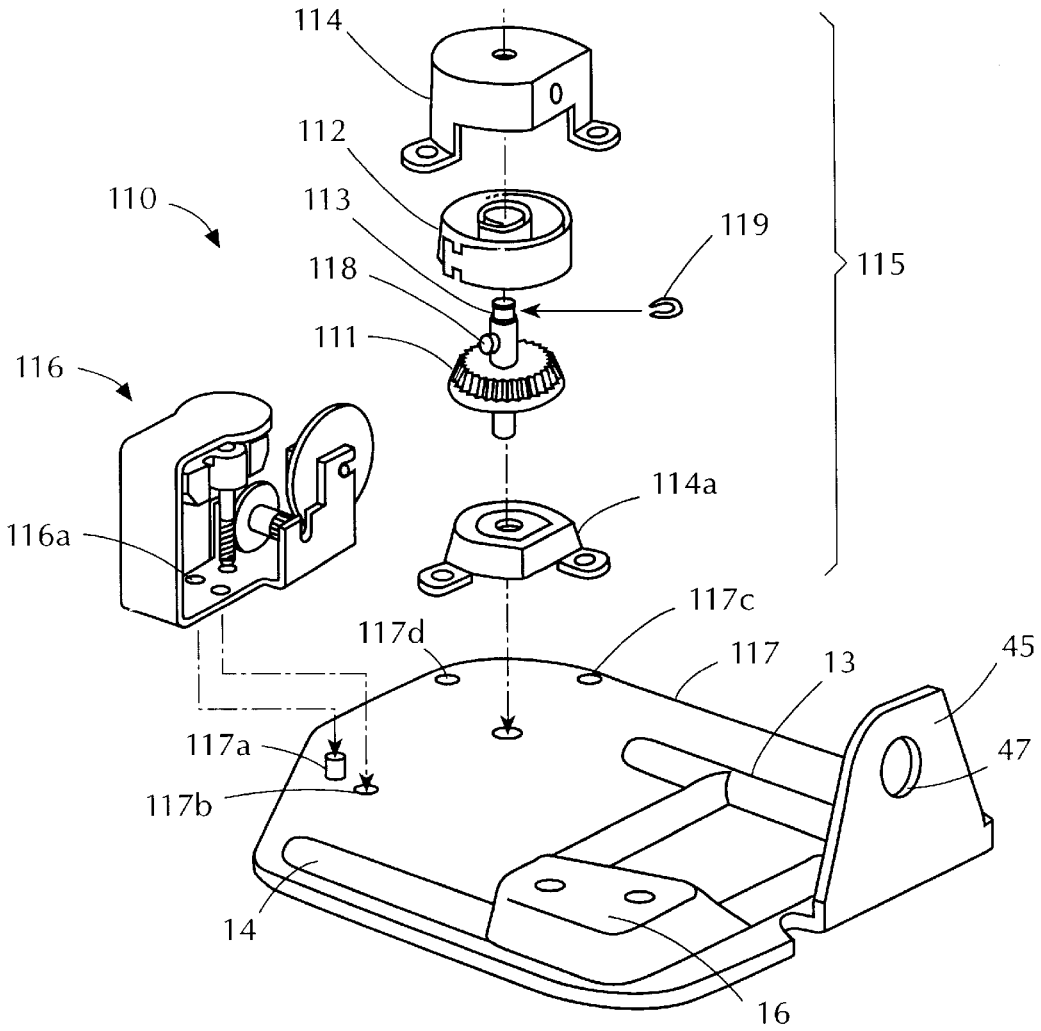
FIG. 5 is an exploded perspective view of a unit in a second embodiment of the music box concerning the present invention.

Next, there will be described a second embodiment of a music box device 110 concerning the present invention referring to FIG. 5. The music box device 110 does not possess a united supporting unit 40 such as the first embodiment, but possessing two units of a power unit 115 and a governor mechanism unit 116 separated from a base frame 117. The contour of the power unit 115 constituted according to a spring storage section 114 and a storage section cover 114*a*. The power unit 115 accommodates a spring gear 111 containing a ratchet means not illustrated and a spring winding shaft 113 for engaging to be hooked a spring 112 and an inner end portion of the spring 112 due to a hooking pin 118 while supporting the spring winding shaft 113 capable of rotation. It is suitable that the spring storage section 114 is integrated with the storage section cover 114*a* according to appropriate means such as caulking. Further, the power unit 115 and the governor mechanism unit 116 are united to be fixed to the base frame due to appropriate uniting means such as a screw and so forth. Furthermore, the governor unit mechanism 116 undergoes accurate positioning in that a positioning pin 117*a* is engaged with a positioning hole 116*a*. Moreover, 117*b*, 117*c*, 117*d* are screwing holes of the power unit 115 and the governor mechanism 116. Reference numeral 119 is a retaining ring for controlling movement in the thrust direction of the spring winding shaft 113. The common parts to the first embodiment are indicated by the same signs as that of the first embodiment to omit description.

Here, the spring storage section 114 made of metal is formed depending on press drawing processing. The storage section cover 114*a* is made of synthetic resin. The storage section cover 114*a* keeps slipping between the storage section cover 114*a* and the spring gear 111 appropriately, thus supporting the spring gear 111. In the meantime, the governor mechanism unit 116 stores to be supported a speed increasing gear train and a governor mechanism in the same way as the first embodiment. A housing of the governor mechanism unit 116 whose body portion made of metal is formed while performing press processing, and whose bearing section made of synthetic resin is formed in such a way of outsert molding in order to secure slipping performance of bearing section.

Figure 6:
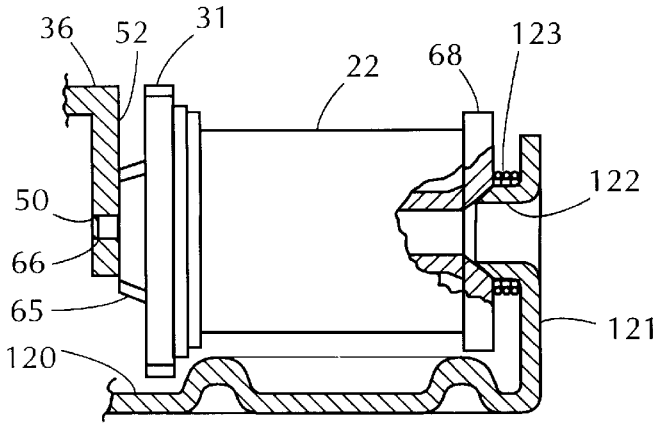
FIG. 6 is a side view indicating relationship between a rotary drum and a bearing frame in fragmentary sectional view in a third embodiment of the music box concerning the present invention.

FIG. 6 to FIG. 9 are a third embodiment to a sixth embodiment indicating relationship between rotary drum and a bearing frame formed on the base frame of the music box device concerning the present invention. FIG. 6 is the third embodiment. In the third embodiment, a supporting shaft 122 protruded from a bearing frame 121 of a base frame 120 depending on drawing processing supports the rotary drum 22 (122) constituted in the same way as the first embodiment. Since a compressed coil spring 123 as a pressurization means pressurizes the rotary drum 122 in the thrust direction, the pivot bearing 46 in the first embodiment becomes useless. It is capable of also employing a leaf spring instead of the compressed coil spring. Another signs indicate that members are common members of the first embodiment.

Figure 7:
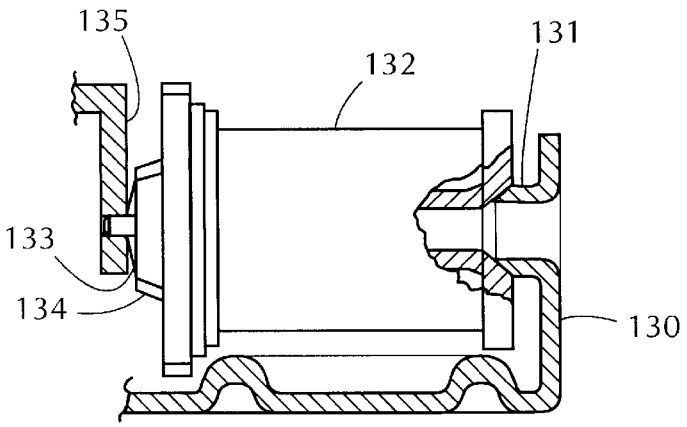
FIG. 7 is a side view indicating relationship between a rotary drum and a bearing frame in fragmentary sectional view in a fourth embodiment of the music box concerning the present invention.

FIG. 7 is the fourth embodiment. In the fourth embodiment, a supporting shaft 131 is protruded from a bearing frame 130 to support a rotary drum 132. Such a constitution is the same as that of the third embodiment. However, a leaf spring 133 as an elastic body, which is a pressurization means for pressurizing the rotary drum 132 in the thrust direction. The leaf spring 133 intervenes between a side surface of a small bevel gear 134 integrated with the rotary drum 132 and a housing side wall 135. When the leaf spring 133 is formed in U-shape, it is capable of inserting in the lateral direction after assembly of the rotary drum 132, so, it is capable of simplifying assembly work.

Figure 8:
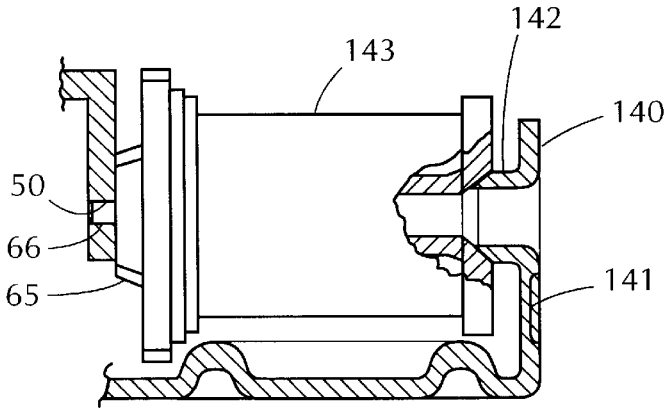
FIG. 8 is a side view indicating relationship between a rotary drum and a bearing frame in fragmentary sectional view in a fifth embodiment of the music box concerning the present invention.

FIG. 8 is the fifth embodiment. In the fifth embodiment, elastic function 141 as a pressurization means is given to a bearing frame 140, which protrudes a supporting shaft 142 to support a rotary drum 143, in the same way as the third embodiment. The elastic function 141 is lower side surface (illustrated in FIG. 8) of the supporting shaft 142 of a bearing frame 140, which is formed by press processing such that surface opposite to the rotary drum 143 becomes thin, thus being easy to undergo elastic deformation. In this case, since there is the elastic function 141 on the bearing frame 140, it is suitable to provide separately no elastic member.

Figure 9:
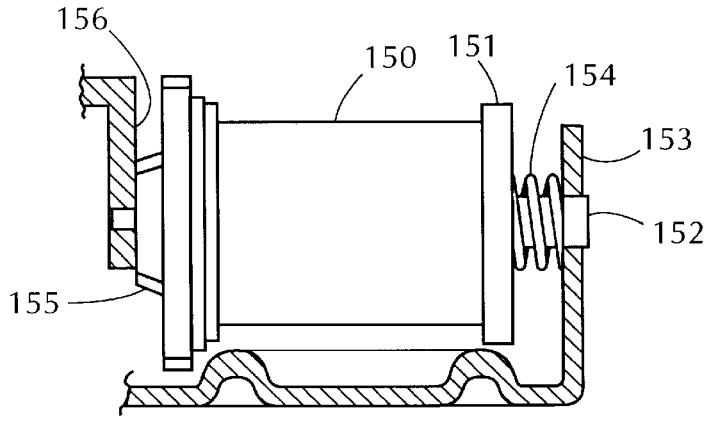
FIG. 9 is a side view indicating relationship between a rotary drum and a bearing frame in fragmentary sectional view in a sixth embodiment of the music box concerning the present invention.

FIG. 9 is the sixth embodiment. In the sixth embodiment, a rotating shaft 152 capable of rotation, which is protruded from the center of a flange 151 of a rotary drum 150, which is supported by a bearing frame 153, and which is pressurized by a compressed coil spring 154 in the thrust direction. The following matters are not illustrated. In the fifth embodiment, a reduced diameter portion capable of rotation formed on the pointed end of a rotating shaft protruded from the flange 151 of the rotary drum 150 is supported by a bearing frame 153. A leaf spring 133 which is the same as that of the fifth embodiment intervenes between a small diameter bevel gear 155 and a housing side wall 156, thus pressurizing the rotary drum 150 in the thrust direction. It is suitable that pressurization force is supported by a reduced diameter step portion of a rotating shaft 162.

In the third embodiment to the sixth embodiment indicated in FIG. 6 to FIG. 9, in the same way as the elastic body according to the compressed coil spring 48 of the first embodiment, pressurization force in the thrust direction pressurized according to various kinds of elastic bodies 123, 133, 141, and 154 accurately maintains position relationship concerning direction of the rotating shaft between the engaging pin 80 provided on the rotary drums 22, 132, 143, and 150 and pointed end of the comb shaped vibration valve 78, thus guaranteeing smooth rotation. Another constitutions in the third embodiment to the sixth embodiment indicated in FIG. 6 to FIG. 9 are capable of being executed while combining any of the first embodiment and/or the second embodiment variously.

INDUSTRIAL APPLICABILITY

As described above, the music box device of the present invention is of course capable of employing as an ordinary device only. In particular, since the spring drive mechanism and governor mechanism are constituted into independent unit construction separated from the base frame, thus being applicable to not only an device of base frame according to plastic deformation processing, but also various types of device of base frame such as casting metal frame and so forth. Further, since the unit of the present invention can be also applied to as stable supply source of spring power, it is capable of being applied to a toy for instance, as parts material of assemble toys such as plastic model.

What is claimed is:

1. A music box device comprising:

a base frame;

a vibration plate which has a plurality of vibration valves arranged in comb-shape, being fixed to said base frame;

a rotary drum which has a plurality of engaging pins arranged in accordance with predetermined musical composition, and said engaging pins snap to be sounded said plurality of vibration valves while engaging with said vibration plate;

a spring drive mechanism which has a spring winding shaft for winding a spring, for driving said rotary drum;

a governor mechanism which has a speed increasing gear train for increasing speed of rotation of said spring drive mechanism and a governor rotating body positioned at final stage of said speed increasing gear train for governing rotation of said rotary drum;

a housing which stores therein said spring, and which forms therein a first bearing section for supporting one end of rotating shaft capable of rotation of said governor rotating body; and a pedestal made of synthetic resin, which forms therein a second bearing section for supporting another end of rotating shaft capable of rotation of said governor rotating body, and which forms therein a supporting member for supporting said speed increasing mechanism capable of rotation, and which is fixed on said base frame and wherein said base frame is made of metal plate material and a plural of ribs are formed in the neighborhood of mounting surface of said vibration plate of said base frame as well as in the neighborhood of said rotary drum, and a part of the rib extends to the second bearing section formed on said pedestal made of resin.

2. A music box device according to claim 1, wherein said pedestal made of resin has a protruded positioning pin that is engaged with said base frame.

3. A music box device according to claim 2, wherein said positioning pin is formed in the neighborhood of a second bearing section formed at said pedestal made of resin.

4. A music box device according to claim 1, wherein said housing forms therein a first spring bearing section for supporting one side of said spring winding shaft capable of rotation, and said pedestal made of synthetic resin forms therein a second spring bearing section for supporting another end of said spring winding shaft capable of rotation.

5. A music box device according to claim 4, wherein said second spring bearing section is inserted to be fitted to a hole formed on said base frame.

6. A music box device according to claim 4, wherein said spring winding shaft provides therein one directional ratchet mechanism which does not transfer rotation of said spring winding shaft on the occasion of spring winding, while when stored force of said spring is released, rotation of said spring winding shaft is transferred, and wherein a slipping section for supporting said one directional ratchet mechanism capable of slipping rotation is formed on circumference with said second spring bearing section as center.

7. A music box device according to claim 6, wherein at least one of the base of said ratchet mechanism while slipping to be contacted to said slipping contact section and said slipping contact section is formed on circular shaped convex portion.

8. A music box device according to claim 6, wherein said slipping contact section is provided on end surface of cylindrical portion formed at said pedestal, and said cylindrical portion is engaged with a hole formed on said base frame.

9. A music box device according to claim 1, wherein said pedestal made of synthetic resin forms therein a supporting section having U-shaped opening for supporting rotating shaft capable of rotation of transfer gear constituting said speed increasing gear train, and wherein said housing forms therein a contact close section for preventing floating of rotating shaft of said transfer gear by closing said U-shaped opening while being faced to said supporting section.

10. A music box device according to claim 9, wherein a pedestal side hooking section is formed at said pedestal made of synthetic resin in the neighborhood of said contact close section, and a housing side hooking section for being engaged with said pedestal side hooking section is formed on said housing.

11. A music box device according to claim 9, wherein said storage section for storing said spring is provided with maintaining section for hooking outer end portion of said stored spring at a side wall thereof, and a reinforcement rib is protruded to be provided in the neighborhood of said maintaining section.

12. A music box device according to claim 1, wherein said housing has a storage section for storing said spring and an opening section for inserting said spring into said storage section, further said pedestal made of synthetic resin has cylindrical protruded edge in which said cylindrical convex edge is fitted into an outer periphery of said opening section in the direction of the spring winding shaft, furthermore said cylindrical convex edge covers outer periphery of said opening section.

13. A music box device according to claim 1, wherein said base frame is formed in accordance with plastic deformation processing of metal plate material, and a bearing frame for supporting another side of said rotary drum is formed into one body while bending, a part elongated from said base frame perpendicular to the base frame.

14. A music box device according to claim 13, wherein a drum bearing section provided at said bearing frame supports said rotary drum capable of rotation, and an elastic body for pressurizing said rotary drum in the thrust direction intervenes between said rotary drum and the bearing frame.

15. A music box device comprising:

a base frame;

a vibration plate which has a plurality of vibration valves arranged in comb-shape, being fixed to said base frame;

a rotary drum which has a plurality of engaging pins arranged in accordance with predetermined musical composition, and said engaging pins snap to be sounded said plurality of vibration valves while engaging with said vibration plate;

a spring drive mechanism including a spring of drive source for driving said rotary drum;

a governor mechanism for governing rotation of said rotary drum;

a unit supporting means for supporting independently said spring drive mechanism and said governor mechanism separately from said base frame; and a unit which is supported independently due to said unit supporting means, being arranged on said base frame and wherein said base frame is made of metal plate material and a plural of ribs are formed in the neighborhood of mounting surface of said vibration plate of said base frame as well as in the neighborhood of said rotary drum, and a part of the rib extends to the second bearing section formed on said pedestal made of resin.

16. A music box device according to claim 15, wherein said unit supporting means comprises:

a pedestal for supporting said spring drive mechanism as well as said governor mechanism, which pedestal is made of synthetic resin such that said pedestal is capable of being fixed on said base frame; and a housing which has a spring storage section for storing said spring, for supporting said governor mechanism and said spring drive mechanism in cooperation with said pedestal.

17. A music box device according to claim 16, wherein a supporting section of U-shaped opening for supporting rotating shaft capable of rotation of transfer gear constituting speed increasing gear train of said governor mechanism is formed at said pedestal made of synthetic resin, further a contact close section for preventing floating of the rotating shaft of said transfer gear by closing said U-shaped opening in face of said supporting section is formed at said housing, furthermore a pedestal side engaging section is formed at said pedestal made of synthetic resin in the neighborhood of said contact close section, and a housing side engaging section for being engaged with said pedestal side engaging section.

18. A music box device according to claim 16, wherein said spring winding shaft provides therein one directional ratchet mechanism which does not transfer rotation of said spring winding shaft on the occasion of spring winding, while when stored force of said spring is released, rotation of said spring winding shaft is transferred, and wherein a slipping section for supporting said one directional ratchet mechanism capable of slipping rotation is formed on said pedestal.

* * * * *